US006450211B1

(12) United States Patent
Graefe et al.

(10) Patent No.: US 6,450,211 B1
(45) Date of Patent: Sep. 17, 2002

(54) WEAVING PROCESS FOR A HIGH-DENSITY FABRIC ON A WATER-JET LOOM

(75) Inventors: Hans Albert Graefe, Schwelm; Frank Leymann, Willich, both of (DE)

(73) Assignee: Acordis Industrial Fibers GmbH, Wuppertal (DE)

( * ) Notice: Subject to any disclaimer, the term of this patent is extended or adjusted under 35 U.S.C. 154(b) by 0 days.

(21) Appl. No.: 09/936,785

(22) PCT Filed: Mar. 16, 2000

(86) PCT No.: PCT/EP00/02338

§ 371 (c)(1),
(2), (4) Date: Sep. 18, 2001

(87) PCT Pub. No.: WO00/56968

PCT Pub. Date: Sep. 28, 2000

(30) Foreign Application Priority Data

Mar. 18, 1999 (DE) ..... 199 12 092

(51) Int. Cl.[7] ..... D03D 47/40; D03D 47/50
(52) U.S. Cl. ..... 139/302
(58) Field of Search ..... 139/302

(56) References Cited

U.S. PATENT DOCUMENTS

| | | | | |
|---|---|---|---|---|
| 3,297,057 A | * | 1/1967 | Mizuno et al. | 139/302 |
| 3,461,920 A | * | 8/1969 | Sakamoto | 139/302 |
| 3,880,201 A | | 4/1975 | Lee, Jr. et al. | |
| 4,296,783 A | * | 10/1981 | Ichimatsu | 139/302 |
| 4,653,546 A | | 3/1987 | Burnett | |
| 5,353,845 A | | 10/1994 | Corain et al. | |
| 5,503,197 A | | 4/1996 | Bower et al. | |
| 6,227,254 B1 | * | 5/2001 | Poe et al. | 139/302 |

FOREIGN PATENT DOCUMENTS

| | | |
|---|---|---|
| EP | 0 747 267 A2 | 12/1996 |
| GB | 1327924 | 8/1973 |
| GB | 2 266 730 A | 11/1993 |
| LI | 514704 | 10/1971 |

* cited by examiner

*Primary Examiner*—Andy Falik
(74) *Attorney, Agent, or Firm*—Oliff & Berridge, PLC

(57) ABSTRACT

Process for producing high-density woven fabrics on a water-jet loom, comprising feeding a warp having up to three catch threads on one edge, inserting weft threads into the warp in the direction of the catch threads, beating-up the weft threads to produce a woven fabric, severing the ends of the weft threads at the edges of the warp, and removing the ends of the weft threads, characterized in that, seen from both edges of the warp, 5 to 60 threads of the warp, following the catch threads on the edge of the warp with the catch threads, are support threads that are maintained at a tension that is 2 to 20 cN/tex higher than that of the threads forming the remaining warp, that after production of the fabric the weft threads between the edges of the remaining warp and the support threads are severed by fusion and joined to threads at the edges of the remaining warp, and that the severed ends of the weft threads are removed together with the support threads and the catch threads.

14 Claims, 2 Drawing Sheets

WEAVING PROCESS FOR A HIGH-DENSITY FABRIC ON A WATER-JET LOOM

BACKGROUND OF THE INVENTION

Field of the Invention

The invention relates to a process for manufacturing high-density woven fabrics on a water-jet loom, and to a fabric produced using this process.

Discussion of Related Art

A process of this type is known from EP-A-0,747,267, for example, and comprises the following steps:

(a) feeding a warp having up to three catch threads on one edge, (b) inserting weft threads into the warp, (c) beating-up the weft threads in the direction of the catch threads to produce a woven fabric, (d) joint twisting of the catch threads to place the weft threads under tension, (e) severing the ends of the weft threads, and (f) removing the ends of the weft threads together with the catch threads.

In producing high-density woven fabrics on a water-jet loom, it has been observed that the resulting fabric is looser at the edges than in the remainder of the fabric. The loose fabric edges make further processing of such fabrics difficult since the edges cannot be maintained under the same tension as the remaining fabric. Fabric producers refer to this as slobby selvedges. This fluttering is particularly noticeable when unrolling the fabrics or transferring them to another roll. The fluttering of the fabric edges becomes more pronounced as the fabric width increases.

To contend with this fluttering, high-density fabrics are normally produced in widths of at most 1.6 m. However, producers of airbags desire fabric widths of at least 1.7 m, and especially 2 m, since cutouts for manufacturing an airbag can then be made with minimum waste.

Frequently, high-density woven fabrics are coated after production with silicone, for example. The fluttering edges prove disadvantageous in the coating process as well and render uniform coating of the fabric almost impossible.

SUMMARY OF THE INVENTION

The object of the present invention is to provide a process as initially described, in which the aforementioned disadvantages are at least reduced. In particular, the weaving process is to be such that the fabric produced is easier to handle in follow-on processing. It is also an object of the invention to provide high-density fabrics that are easy to handle.

FIG. 2 represents a water-jet weaving machine as used in the present process including hot knives 7 and 8, severed ends of the weft and support threads 9, support threads 10, base structure 11, warp 12, warp beam 14, tensioning means 18, first harness mechanism 24, second harness mechanism 26, water jet nozzle 28, weft thread 30, reciprocating reed 31, cutting means 34, catch cord 36, catch plate 38, vacuum line 40, twister 42, support brackets 52 and produced fabric 70.

DESCRIPTION OF PREFERRED EMBODIMENTS

Figure 1:
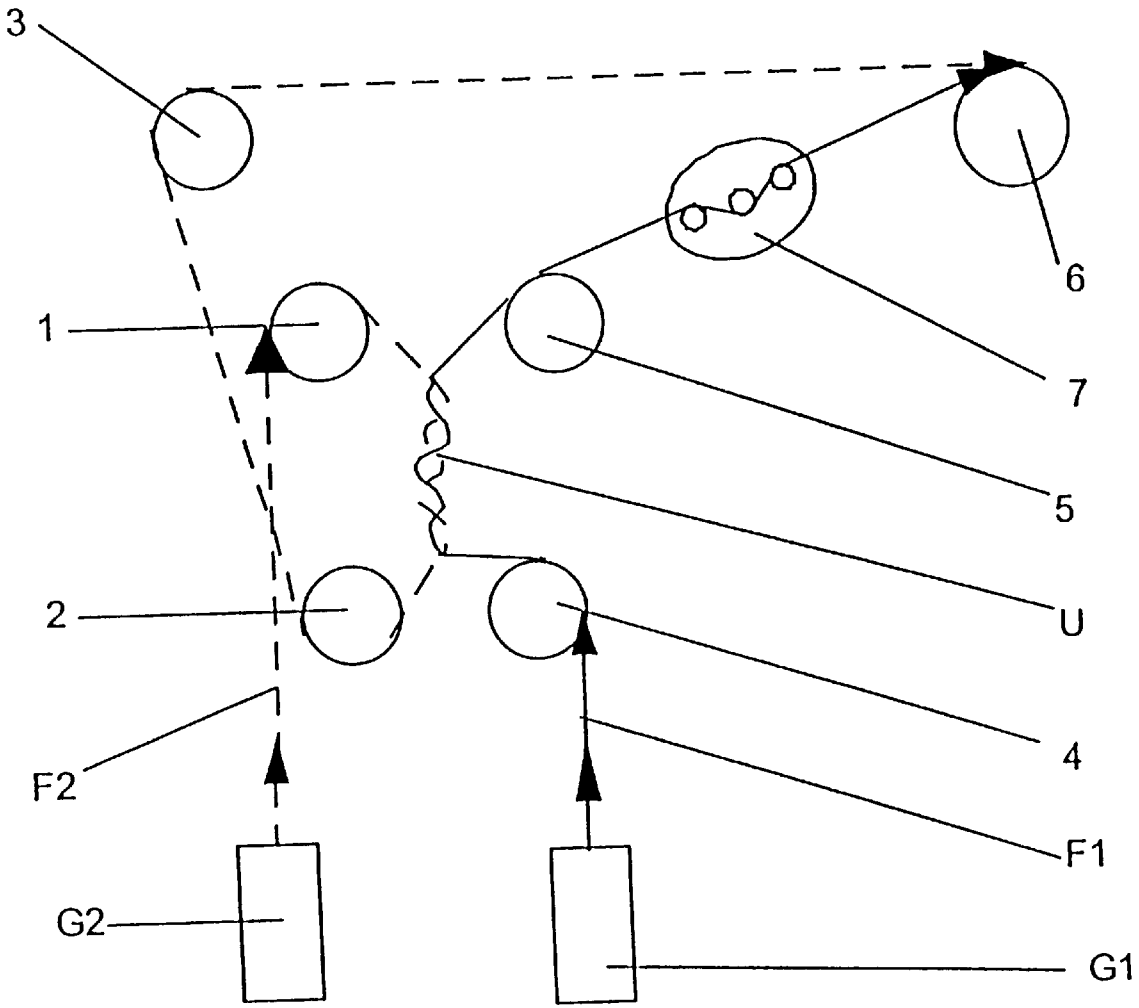
FIG. 1 is a diagram of the thread routing to measure the static friction of two different threads against each other in accordance with the present invention.
Figure 2:
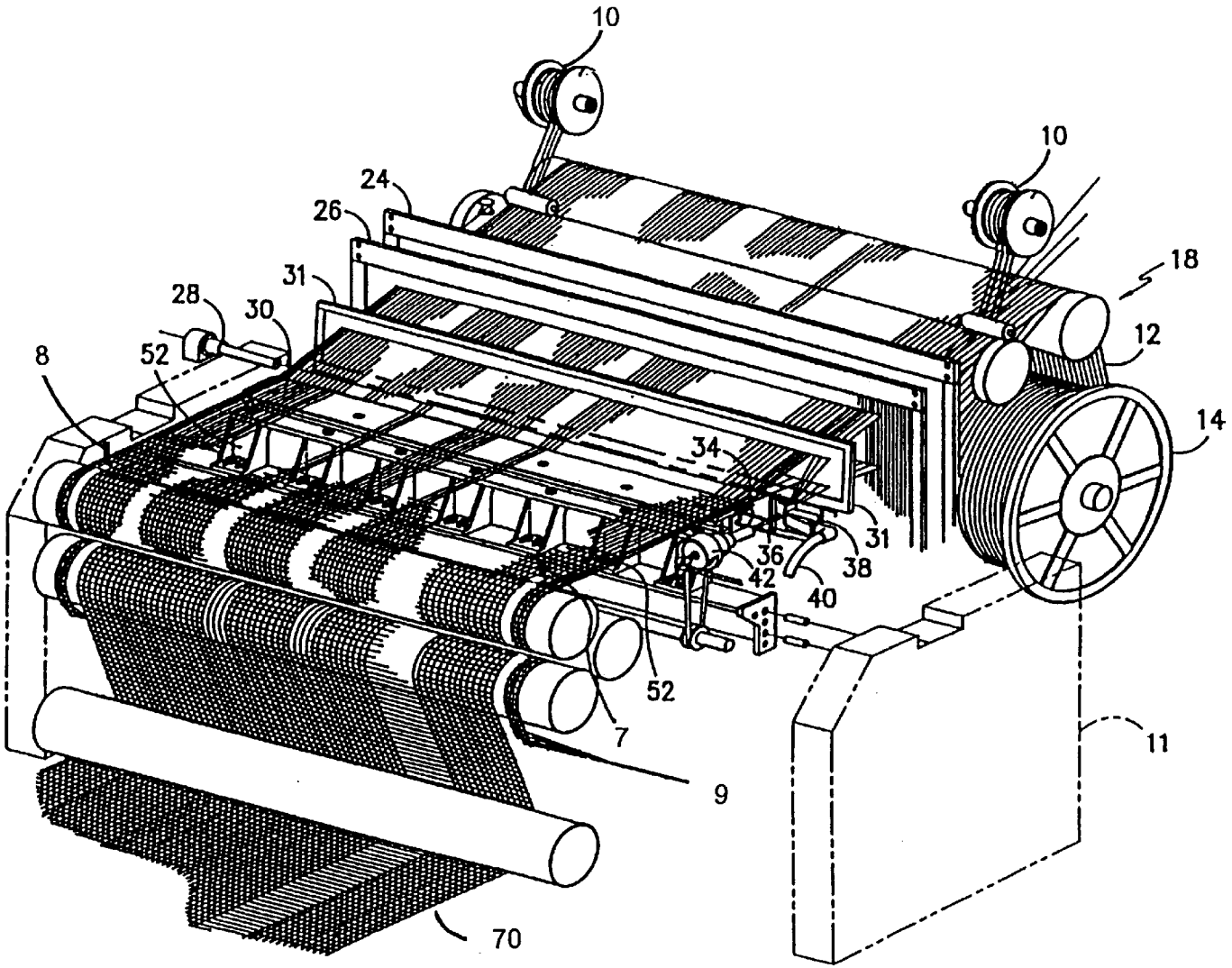
FIG. 2 represents a water-jet weaving machine used in the present process.

According to the invention, the warp employed consists of catch threads, support threads, and the threads of the remaining warp. The warp therefore contains a total of four thread groups. These thread groups occur in the following order from one edge of the warp to the other in the direction of weft insertion:

(i) support threads, (ii) threads of the remaining, actual warp, (iii) support threads, and (iv) catch threads, wherein the catch threads, support threads, and threads of the remaining warp have different functions during the weaving process.

Surprisingly, it has been observed that when adhering to these conditions, the fabric edges have properties that are at least approximately the same as those of the remaining fabric. Handling of the. fabric produced according to the invention is considerably improved. Fluttering of the warp edges is rarely observed.

High-density woven fabrics in the context of the present invention are those in which the thread density is especially high in both the warp and weft directions and approaches the thread density achievable with the respective loom. For example, the resulting high-density woven fabrics have thread counts of 26 to 30 threads per cm when using threads with a yarn titer of 235 dtex, 18 to 28 threads per cm with a yam titer of 350 dtex, and 17 to 25 threads per cm with a yam titer of 470 dtex. The thread counts cited here apply in particular to plain weaves and are adjusted accordingly for other weaves. A common factor for these adjustments is the cover (kappa) factor.

The process of the invention succeeds particularly well if the distances between adjacent threads, including the support and catch threads, is the same over the entire width of the warp. Thus, the distance between two different thread groups is also the same as the distance between adjacent threads in the same group.

In the process of the: invention, it is advantageous if the support threads are fed to the edges of the warp by separate sectional warp beams onto which the support threads have been wound as a yarn sheet. In this manner, the tension required for the support threads can be adjusted particularly advantageously, by procedures that are known.

As a rule, it is sufficient if there is a yam sheet with 10 to 40 support threads on each edge of the warp.

It has proven particularly advantageous if the support threads are selected with a hot-air shrinkage, measured at 190° C., of 1% to 4%, and preferably 1% to 3%. Surprisingly, such threads allow an adjustment of the support thread tension required for the process of the invention that is particularly simple and uniform for all threads.

The process of the invention succeeds particularly well if twisted threads are used as the support threads. It has proven especially beneficial if the support threads have 200 to 700 turns per meter. The use of double-twisted threads as support threads is recommended. Double-twisted threads are those in which a multi-filament yarn is first twisted and then two or more of such twisted multi-filament yarns are in turn twisted together. For the second twisting as well, it is advantageous for the twisted multi-filament yams to have 200 to 700 turns per meter. Twisting of the twisted multi-filament yarns in the direction opposite the twist of the multi-filament yarns is recommended.

The process of the invention succeeds particularly well if support threads are selected that have a thread/thread friction between the weft and support threads of 20 to 70 cN.

The thread/thread friction is measured as follows: A Rothschild (Zurich) R-1188"F meter" and R-1083"F meter winder" are used. The principle for measuring the static friction of a thread against itself is described in sections 5.5 and 5.10 of the F meter user's manual.

To measure the static friction of two different threads against each other, the measurement arrangement was modified slightly. The rolls numbered 1, 2, 4, 5, and 6 in the drawing and the thread tension meter 7 are components of the F-meter winder. Roll 3 was added. The drive for roll 6 can be regulated and takes up the measured thread at a rate of 10 mm/min.

The thread routing is indicated by the figure. One thread (F1, solid line) is loaded with a freely suspended 10 cN weight G1 and routed from the right side over roll 4, from the left side over roll 5, past thread tension meter 7, and once around roll 6, and is then secured to the axis of the latter. The second thread (F2, dashed line) is also loaded with a 10 cN weight G2 (freely suspended) and routed from the left side over roll 1. Thread F2 is then wrapped around thread F1 four times toward the right and then routed to the left again prior to thread F1, yielding 3 ½ turns. Thread F2 is routed under roll 2 and over roll 3 to take-up roll 6, where it is secured as for thread F1. For the threads F1 and F2, a length is selected such that weights G1 and G2 are suspended about 1 m below the measurement apparatus.

The motor (not shown) for roll 6 is now turned on. After 2–3 minutes running time to align the threads, thread F1 is positioned in the thread tension meter. The measurements are displayed on the R-1188 F meter and recorded on an ABB Goerz SE 120 plotter. The force determined in this manner is used as a measure of the thread/thread friction.

It is important for the weft threads to be severed by fusion. Severing by fusion is commonly known. In this case, the thread is heated at one location to a temperature at least equal to, but generally higher than, the thread melting temperature. In the simplest case, a wire heated to high temperature can be used, against which the weft thread is positioned, heated until molten, and severed by moving it further. As a rule, the wire is heated to a temperature that renders it red-hot. However, a heated knife can also be used, such as described in EP-A-0 747 267 for severing the weft threads at the catch threads.

It is advantageous for severing by fusion to take place such that the ends of the weft threads in the molten state adhere to the threads at the edges of the warp. The molten end of the weft thread is used to attach the weft thread to at least one edge thread of the warp. In this manner, a particularly stable warp edge is attained, which significantly improves the handling of the fabric produced.

It is especially beneficial if severing by fusion is performed such that the ends of the weft threads are fused in the molten state with the threads at the edges of the warp. This severing by fusion can be performed such that edge threads of the remaining warp that are adjacent to the hot severing element are also heated to the melting point, so that a continuous weld is produced along the edges of the finished fabric and plays a role in avoiding the aforementioned fluttering of the selvedges.

The object of the invention is also satisfied by a woven fabric producible using the process of the invention. The fabric of the invention differs from fabrics produced using the conventional weaving process on water-jet looms in that the weft threads are severed on both edges of the fabric, while the weft threads in fabrics conventionally produced on water-jet looms are severed on only one edge of the fabric and protrude somewhat from the fabric on the other edge. In particular, when employing severing by fusion at the fabric edges, the fabrics produced using the process of the invention are distinguished from conventional fabrics produced on water-jet looms by the welds running longitudinally along both edges. The feel of the fabric of the invention in the edge region is at least nearly the same as the feel between the edges, such as in the center of the fabric.

The fabrics of the invention are excellently suited for producing airbags, parachutes, and sailcloths, and for all applications in which extremely dense woven fabrics are required. For example, yarns with an overall titer of 470 dtex can be woven at a density of up to 25 threads per cm in the warp and weft directions.

The invention will now be explained in more detail on the basis of the following example:

EXAMPLE

A warp with a width of 207 cm, consisting of nylon-6,6 threads, was fed to a water-jet loom. Each thread of the warp had an overall titer of 470 dtex and 72 filaments. The hot-air shrinkage of these yarns, measured at 190° C. after heating for 5 minutes, was 8.2%.

Two yarn sheets, consisting of 40 nylon-6,6 threads and each wound on a sectional warp beam, were also fed to the water-jet loom such that they were adjacent to the edge threads of the warp in the reed of the loom. These yarns acted as support threads and had an overall titer of 234 dtex and 68 filaments. The supportthread yarns were double-twisted threads according to a Z 476 S 637 scheme. This scheme is realized by initially twisting a yarn with 34 filaments in the S direction with 637 turns per meter, and then twisting two yams, previously twisted in this manner, in the Z direction with 476 turns per meter. The support threads had a hot-air shrinkage of 1.8%, measured under the same conditions as those for the hot-air shrinkage of the warp yarns.

Furthermore, the usual 4 catch threads for water-jet looms were fed outside the yarn sheet of support threads, which was opposite the weft-insertion jet of the water-jet loom.

The weft thread employed was a nylon-6,6 multi-filament yarn with an overall titer of 470 dtex and 72 filaments. The weft threads had a hot-air shrinkage of 8.2%. The thread/thread friction between the weft and support threads was 47.5 cN.

The threads of the warp, the support yarn sheet, and the catch threads were introduced adjacently into the reed of the water-jet loom, whereby the reed had 100 openings per 10 cm and two threads were drawn into each reed opening. The warp threads were maintained at a tension of 120 cN/tex and the support threads at a tension of 123 cN/tex.

A woven fabric was produced using the yarns thus described. The catch threads were twisted to place the weft threads under tension and removed by suction, after severing the weft threads outside the support threads, together with the severed weft thread ends. The resultant fabric was then further processed by directing a red-hot wire between each of the support threads and the respective outermost thread of the warp, severing the weft threads and fusing them with the outermost threads of the warp. This resulted in a weld that could be felt along each edge of the warp.

The fabric produced in this manner had 21.5 threads per cm in the warp direction and 21.5 threads per cm in the weft direction. The two edges of the fabric had the same feel as the fabric interior. When rolling the fabric from one beam to another, the fabric remained taut even into the edge regions, and the slobby selvedges known to those skilled in the art was not observable. This fabric also lent itself to particularly uniform coating with an aqueous silicone dispersion over the entire width of the fabric.

What is claimed is:

1. A process for producing a high-density woven fabric on a water-jet loom, comprising:

(a) feeding a warp having up to three catch threads on a first edge and having a second edge opposite to the first edge, (b) inserting weft threads into the warp, (c) beating-up the weft threads in the direction of the catch threads to produce a woven fabric, (d) jointly twisting the catch threads to place the weft threads under tension, (e) severing the ends of the weft threads, and (f) removing the ends of the weft threads together with the catch threads, using 5 to 60 warp threads as support threads following the catch threads on the first edge of the warp, using 5 to 60 warp threads as support threads on a second edge of the warp, maintaining the support threads at a tension that is higher than the threads forming remaining warp, severing the weft threads located between the edges of the remaining warp and catch threads by fusion, joining the edges of the severed weft threads to the edges of the remaining warp, and removing the severed ends of the weft threads together with the support threads.

2. The process according to claim 1 comprising the additional step of setting a same distance between the adjacent support and catch threads over an entire width of the warp.

3. The process according to claim 1 comprising the additional step of feeding the support threads to the edges of the warp from separate sectional warp beams, onto which the support threads have been wound as a yam sheet.

4. The process according to claim 1 comprising using 10 to 40 threads on each edge of the warp as support threads.

5. The process according to claim 1 comprising using support threads having a hot-air shrinkage of 1% to 4%, measured at 190° C.

6. The process according to claim 5 comprising using support threads having a hot-air shrinkage of 1% to 3%, measured at 190° C.

7. The process according to claim 1 comprising using support threads comprising twisted threads.

8. The process according to claim 7 comprising using support threads having 200 to 700 turns per meter.

9. The process according to claim 7 comprising using support threads comprising double-twisted threads.

10. The process according to claim 6 comprising using support threads comprising double-twisted threads.

11. The process according to claim 1 comprising using support threads having a thread/thread friction between the weft and support threads of 20 to 70 cN.

12. The process according to claim 1, wherein the severing by fusion comprises the additional step of adhering the ends of the weft threads in the molten state to the threads at the edges of the remaining warp.

13. The process according to claim 12, wherein the severing by fusion comprises the additional step of fusing the ends of the weft threads in the molten state with the threads at the edges of the remaining warp.

14. Fabric producible according to one of claims 1 to 12.

* * * * *

UNITED STATES PATENT AND TRADEMARK OFFICE

CERTIFICATE OF CORRECTION

PATENT NO. : 6,450,211 B1 
DATED : September 17, 2002
INVENTOR(S) : Hans Albert Graefe and Frank Leymann It is certified that error appears in the above-identified patent and that said Letters Patent is hereby corrected as shown below:

Column 2,
Line 39, delete the ":" after "the".

Column 6,
Line 4, change "yam" to -- yarn --.

Signed and Sealed this

Twenty-eighth Day of January, 2003

JAMES E. ROGAN
*Director of the United States Patent and Trademark Office*